US009783891B2

(12) United States Patent
Blickensderfer et al.

(10) Patent No.: US 9,783,891 B2
(45) Date of Patent: Oct. 10, 2017

(54) IRON BORON ALLOY COATINGS AND A PROCESS FOR THEIR PREPARATION

(71) Applicant: Atotech Deutschland GmbH, Berlin (DE)

(72) Inventors: Jacob Blickensderfer, Cleveland, OH (US); Rohan Akolkar, Beachwood, OH (US); Paige Altemare, Rocky River, OH (US); Kay-Oliver Thiel, Berlin (DE); Hans-Jürgen Schreier, Velten (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 15/127,036

(22) PCT Filed: Mar. 17, 2015

(86) PCT No.: PCT/EP2015/055508
§ 371 (c)(1),
(2) Date: Sep. 19, 2016

(87) PCT Pub. No.: WO2015/161959
PCT Pub. Date: Oct. 29, 2015

(65) Prior Publication Data

US 2017/0121824 A1 May 4, 2017

(30) Foreign Application Priority Data

Apr. 24, 2014 (EP) ..... 14165797

(51) Int. Cl.
*C23C 18/50* (2006.01)
*C23C 18/16* (2006.01)

(52) U.S. Cl.
CPC ..... *C23C 18/50* (2013.01); *C23C 18/1633* (2013.01)

(58) Field of Classification Search
CPC ..... C23C 18/50; C23C 18/1633
USPC ..... 106/1.22, 1.27
See application file for complete search history.

(56) References Cited

U.S. PATENT DOCUMENTS 3,385,725 A 5/1968 Schmeckenbecher
3,483,029 A 12/1969 Koretzky et al.
3,532,541 A * 10/1970 Koretzky ..... H01F 10/10 106/1.25
3,723,158 A * 3/1973 Miller ..... C23C 18/50 106/1.27
3,859,130 A 1/1975 Parker et al.
3,889,017 A * 6/1975 Franz ..... C23C 18/50 106/1.27
4,181,760 A 1/1980 Feldstein
5,897,692 A * 4/1999 Kotsuka ..... C23C 18/50 106/1.27
7,223,695 B2 * 5/2007 Zhong ..... C23C 18/32 257/E21.174
8,292,993 B2 * 10/2012 Inagawa ..... C23C 18/32 106/1.22
2005/0095855 A1 * 5/2005 D'urso ..... C23C 18/50 106/1.22
2009/0117285 A1 5/2009 Dinderman et al.

OTHER PUBLICATIONS

W. Lingling et al., "Chemical Iron-Tin-Boron Films", Metal Finishing 2001, vol. 99 (6), pp. 92-98.
N. Fujita et al., "Fabrication of Amorphous Iron-Boron Films by Electroless Plating", Applied Surface Science 1997, vol. 113/114, pp. 61-65.
Hu Wangyu at al., Structure and Crystallization of Amorphous Fe—B Alloys Obtained by Chemical Plating, Physica B 1991, vol. 175, pp. 396-400.
PCT/EP2015/055508; PCT International Search Report and Written Opinion of the International Searching Authority dated May 27, 2015.
PCT/EP2015/055508; PCT International Preliminary Report on Patentability dated Jul. 15, 2016.

* cited by examiner

*Primary Examiner* — Helene Klemanski
(74) *Attorney, Agent, or Firm* — Renner, Otto, Boisselle & Sklar, LLP

(57) ABSTRACT

An aqueous plating bath for the electroless deposition of iron boron alloy coatings, characterized in that it comprises at least one iron ion source, at least one boron based reducing agent, at least one complexing agent, at least one pH buffer and at least one base wherein its pH value is 11 or higher and the molar ratio of the boron based reducing agents in relation to the iron ions in the aqueous plating bath is at least 6:1. Also, a process for the use of said aqueous plating bath is disclosed. The aqueous plating bath according to the invention shows good stability and plating rate and yields glossy and homogeneous iron boron alloy coatings on various substrates. It is an advantage of the plating bath that it does not require any sacrificial anodes.

15 Claims, 2 Drawing Sheets

IRON BORON ALLOY COATINGS AND A PROCESS FOR THEIR PREPARATION

The present application is a U.S. National Stage Application based on and claiming benefit and priority under 35 U.S.C. §371 of International Application No. PCT/EP2015/055508, filed 17 Mar. 2015, which in turn claims benefit of and priority to European Application No. 14165797.3 filed 24 Apr. 2014, the entirety of both of which is hereby incorporated herein by reference.

FIELD OF THE INVENTION

The invention relates to an electroless deposition process to form iron boron alloy coatings on surfaces, the plating bath used therefor and the coatings formed therewith and an exemplary application of the coatings obtained by said process in the electronics industry.

BACKGROUND OF THE INVENTION

Coatings made up of nickel and phosphorus deposited by electroless deposition processes (NiP-coatings) are commonly used as for example corrosion-resistant coatings in the electronics industry. However, as nickel is detrimental to the environment and dangerous to consumers' health the focus recently has shifted towards new materials. Iron becomes more and more appreciated in domains that other materials dominated in the past like for example as base for coating materials since it is ubiquitous, relatively cheap and non-toxic.

However, the electroless deposition of iron based coatings proved difficult due to the formation of undesired side-products and a lack of stability of plating baths. It is well-known in the art that electroless iron deposition easily yields the formation of iron oxides, iron hydroxides and iron oxo hydroxides or other precipitates under conditions suitable for the electroless deposition of other metals.

Hitherto, it was therefore common to employ a sacrificial anode (e.g. made of aluminium) in plating solutions for deposition of binary iron alloy (e.g. iron boron) coatings. N. Fujita et al., Applied Surface Science 1997, volume 113/114, pages 61-65 teaches such a process for the deposition of binary iron boron alloys but reports that the alloy deposition stopped as soon as the electrical connection between the substrate and the sacrificial anode was interrupted. Sacrificial anodes are typically base metal substrates in forms such as wires or strips which can be used as external sources of electrons. These sacrificial anodes are therefore electrically connected with the substrate (while they may be immersed into the plating bath) and provide the electrons necessary to reduce iron on the surface of the substrate. Such a plating method is essentially an electrolytic plating process since the sacrificial anode acts as local battery. This requirement of electrical connection renders these electrolytic plating baths in need of a sacrificial anode incompatible with today's demands of miniaturization in the electronics industry where many small substrates have to be coated at the same time (which all would have to be electrically connected to a sacrificial anode). Also, non-conductive substrates cannot be used as they do not allow for any electrons to pass through them to their surface. Another example for this technology is Hu Wangyu, Zhang Bangwei, Physica B 1991, volume 175, pages 396-400. Also, Chinese patent CN 100562603 C relates to the electroless deposition of ternary rare earth-iron-boron alloys on copper foils using a sacrificial anode. The plating bath disclosed therein further requires the metallic substrate to be activated with a catalyst before plating occurs. W. Lingling et al. (in Metal Finishing 2001, volume 99 (6), pages 92-96) report ternary iron-tin-boron alloys to be depositable with the use of such sacrificial aluminium anodes.

Contrary to these electrolytic metal deposition methods using an external source of electrons electroless processes are known for the formation of films of many metals. Electroless plating is the controlled autocatalytic deposition of a continuous film of metal without the assistance of an external supply of electrons. The main components of electroless metal plating baths are the source of metal ions, a complexing agent, a reducing agent, and, as optional ingredients stabilising agents, grain refiners and pH adjustors (acids, bases, buffers). Complexing agents (also called chelating agents in the art) are used to chelate the metal to be deposited and prevent the metal from being precipitated from solution (i.e. as the hydroxide and the like). Chelating metal renders the metal available to the reducing agent which converts the metal ions to their metallic form. A further form of metal deposition is immersion plating. Immersion plating is another deposition of metal without the assistance of an external supply of electrons and without chemical reducing agent. The mechanism relies on the substitution of metals from an underlying substrate for metal ions present in the immersion plating solution. In the context of the present invention electroless plating is to be understood as autocatalytic deposition with the aid of a chemical reducing agent (referred to a "reducing agent" herein).

A possibility to form iron containing deposits by electroless processes is the deposition of ternary alloys of nickel, iron and phosphorous or boron. Such processes have been reported in U.S. Pat. No. 3,385,725 and U.S. Pat. No. 3,483,029. The deposits described therein consist mostly of nickel and contain 2% or less of phosphorous or boron. Although U.S. Pat. No. 3,385,725 teaches plating baths containing equally high amounts of nickel and iron, the deposits formed consist mostly of nickel. The disclosed methods are thus unsuitable to form deposits with high iron contents.

U.S. Pat. No. 3,150,994 relates to a method of electrolessly plating metal boron alloys onto metal surfaces. It also discloses a method to form iron boron alloys on said substrates specifically from a plating bath consisting of a large excess of ammonia, a soluble iron salt and an ionic borohydride. However, the disclosed plating is inevitably accompanied by a precipitation of the formed alloy in the bath itself and, thus, results in a limitation of the lifetime of the bath. It is particularly disadvantageous of the disclosed method that the precipitate itself is an active catalytic site which facilitates further deposition.

British patent application number GB 1339829 discloses a method to deposit transparent coatings made of iron boron alloys on window glass. A necessary prerequisite of this method is, however, the employment of a hydrazine derivative in the plating bath. This is incompatible with today's security demands due to the compound's toxic and carcinogenic potential. Also, an activation step of the substrate prior to plating is required.

British patent application number GB 1365172 teaches a prolonged lifetime of the plating bath according to the aforementioned British patent application by employing carbonyl compounds therein. However, the use of hydrazine as further reducing agent and the activation step are still necessary.

US 2009/0117285 discloses an electroless deposition method for iron boron alloys on previously activated cellulose fibres. However, this method requires a very narrow pH-operation window to be used. Also, the bath disclosed therein lacks stability and plating rate (see example 1).

Objective of the Present Invention

It is therefore an objective of the present invention to provide a process for electroless deposition of iron boron alloy coatings on substrates with high plating rates which does not require the use of any sacrificial anode (or any other external source of electrons).

It is another objective of the present invention to provide a stable plating bath composition to be employed in said process.

It is yet another objective of the present invention to provide iron boron alloy coatings on substrates to be formed by said process.

It is a further objective of the present invention to provide corrosion resistant iron boron alloy coatings on substrates to be obtained by said process.

SUMMARY OF THE INVENTION

The above-mentioned objectives are solved by the plating bath and the process for its use according to the invention. The inventive aqueous plating bath for the electroless deposition of iron boron alloy coatings, is characterized in that it comprises (i) at least one iron ion source;
(ii) at least one boron based reducing agent;
(iii) at least one complexing agent;
(iv) at least one pH buffer; and
(v) at least one base,
wherein the pH value of the aqueous plating bath is 11 or higher and the molar ratio of the boron based reducing agents in relation to the iron ions in the aqueous plating bath is at least 6:1.

The inventive process for the electroless deposition of iron boron alloy coatings on substrates, is characterized in that the process comprises the steps (a) providing a substrate, and
(b) contacting said substrate with an aqueous plating bath for the electroless deposition of iron boron alloy coatings, characterized in that the aqueous plating bath comprises
  (i) at least one iron ion source;
  (ii) at least one boron based reducing agent;
  (iii) at least one complexing agent;
  (iv) at least one pH buffer; and
  (v) at least one base,
  wherein the pH value of the aqueous plating bath is 11 or higher and the molar ratio of the boron based reducing agents in relation to the iron ions in the aqueous plating bath is at least 6:1 and thereby depositing an iron boron alloy coating onto said substrate.

The aqueous plating bath according to the invention and the inventive process for its use allow for stable plating conditions of iron boron alloy coatings. The process further allows for iron boron alloy coatings to be formed on substrates with high plating rates. The iron boron alloy coatings formed therewith are glossy and homogeneous in thickness distribution and coverage of substrates. Also, they are amorphous and show sufficient corrosion resistance to be used in the electronics industry, for example in the manufacturing of printed circuit boards (PCB) or integrated circuit substrates (IC substrates).

DETAILED DESCRIPTION OF THE INVENTION

Figure 1:
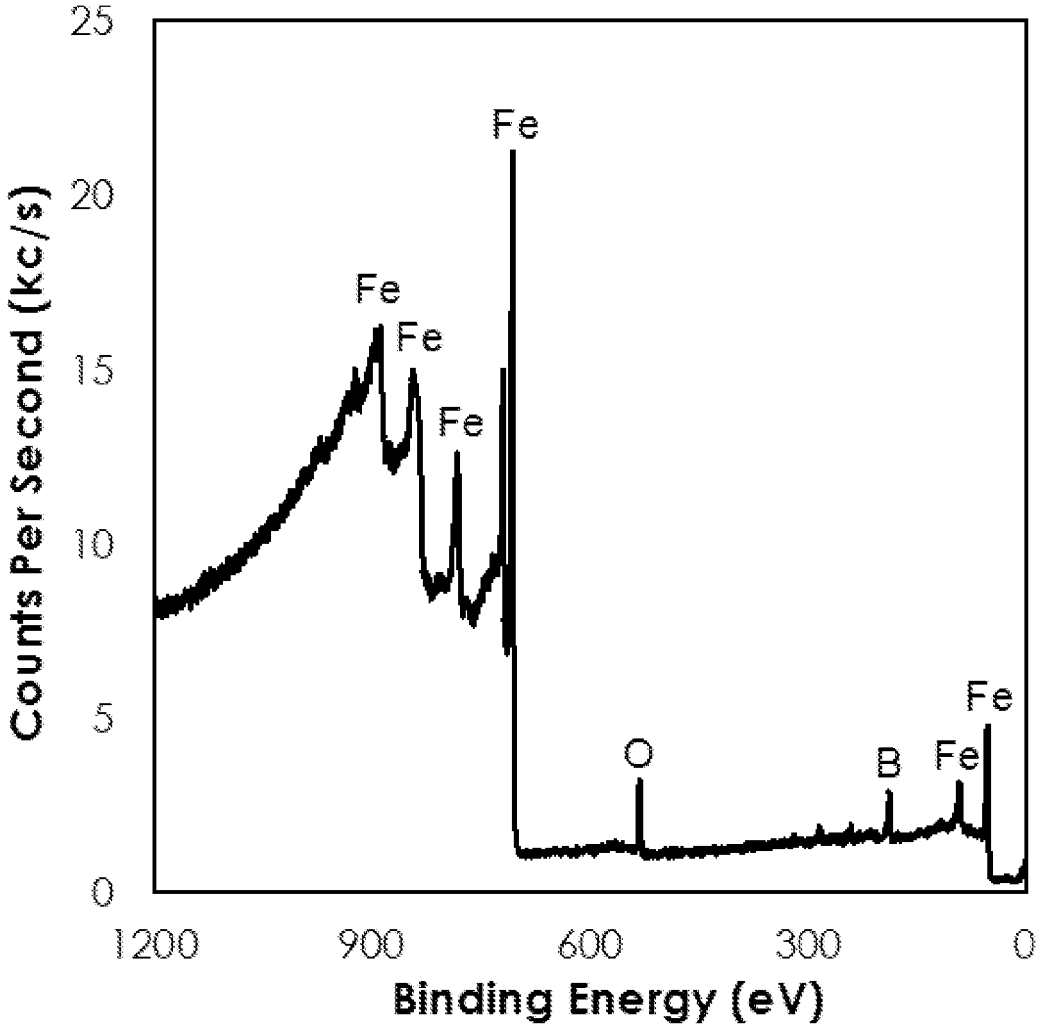
FIG. 1:
An x-ray photo-electron spectrum (XPS) of an iron boron alloy coating formed by the process according to the invention (see example 4).

The objectives of the present invention are solved by using an inventive aqueous plating bath in the process according to the invention which are described in more detail hereinafter.

The aqueous plating bath for the electroless deposition of iron boron alloy coatings according to the invention is characterized in that it comprises (i) at least one iron ion source;
(ii) at least one boron based reducing agent;
(iii) at least one complexing agent;
(iv) at least one pH buffer; and
(v) at least one base,
wherein the pH value of the aqueous plating bath is 11 or higher and the molar ratio of the boron based reducing agents in relation to the iron ions in the aqueous plating bath is at least 6:1.

The inventors have found that the hitherto used sacrificial anode could be omitted by using an aqueous plating bath for depositing iron boron alloy coatings which has a pH of 11 or higher and wherein the molar ratio of the boron based reducing agents in relation to the iron ions in the aqueous plating bath is at least 6:1. Such plating baths are stable and allow for high plating rates of 100 nm per hour or higher, e.g. between 100 to 500 nm per hour.

The aqueous plating bath according to the present invention comprises at least one iron ion source. The at least one iron ion source is preferably a water soluble ferrous salt such as ferrous halides, ferrous sulphate, ammonium ferrous sulphate, ferrous nitrate and/or the respective hydrates of a ferrous salt.

The concentration of iron ions provided by at least one iron ion source in the aqueous plating bath is ranged from 10 mmol/l to 120 mmol/l, preferably from 25 mmol/l to 75 mmol/l, most preferred from 40 mmol/l to 60 mmol/l. Iron ion concentrations exceeding 120 mmol/l might result in unstable plating baths due to the formation of iron precipitates in the plating bath itself.

The at least one boron based reducing agent in the aqueous plating bath according to the present invention is a water soluble boron based reducing agent. These water soluble boron based reducing agents are selected from the group consisting of alkali borohydrides such as sodium borohydride, potassium borohydride and aminoboranes such as dimethylaminoborane. Alkali borohydrides are preferred according to the present invention. The aqueous plating bath is preferably free of hydrazine based reducing agents as they are carcinogenic.

The aqueous plating bath comprises a molar excess of the boron based reducing agents in relation to the iron ions. The molar ratio of the boron based reducing agents in relation to the iron ions in the aqueous plating bath is at least 6:1, and it is preferred that the molar ratio lies in the range of 6:1 to 10:1. If the molar excess of the boron based reducing agents to the iron ion is 5:1 or below plating of an iron boron alloy coating occurs sluggishly or not at all. Typically, it ceases after a short time of plating (example 6, bath 1). If the molar ratio is 11:1 or higher the plating occurs continuously albeit slowly (example 6, bath 3).

At least one complexing agent or a mixture of complexing agents is included in the aqueous plating bath according to the invention capable or forming complexes with iron ions, preferably Fe(II)-ions, in aqueous media.

Carboxylic acids, hydroxycarboxylic acids, aminocarboxylic acids and salts of the aforementioned or mixtures thereof may be employed as complexing agents. Useful carboxylic acids include the mono-, di-, tri- and tetracarboxylic acids. The carboxylic acids may be substituted with various substituent moieties such as hydroxy or amino groups and the acids may be introduced into the aqueous plating bath as their sodium, potassium or ammonium salts. Some complexing agents such as acetic acid or glycine, for example, may also act as pH buffer, and the appropriate concentration of such additive components can be optimised for any aqueous plating bath in consideration of their dual functionality.

Examples of such carboxylic acids which are useful as the complexing agents in the plating bath of the present invention include: monocarboxylic acids such as acetic acid, hydroxyacetic acid (glycolic acid), aminoacetic acid (glycine), 2-amino propanoic acid (alanine), 2-hydroxy propanoic acid (lactic acid); dicarboxylic acids such as succinic acid, amino succinic acid (aspartic acid), hydroxy succinic acid (malic acid), propanedioic acid (malonic acid), tartaric acid; tricarboxylic acids such as 2-hydroxy-1,2,3-propane tricarboxylic acid (citric acid); and tetracarboxylic acids such as ethylene diamine tetra acetic acid (EDTA). In one embodiment, mixtures of two or more of the above complexing agents are utilised in the aqueous plating bath according to the present invention. The use of tartaric acids or salts thereof as at least one complexing agent is preferred according to the invention.

The molar ratio of the complexing agents to the iron ions present in the aqueous plating bath is preferably in the range from 1:1 to 10:1, even more preferably in the range from 2:1 to 8:1, most preferred in the range from 2:1 to 4:1.

The pH value of the aqueous plating bath according to the invention is 11 or higher. If the pH value of the aqueous plating bath drops below 11, the aqueous plating bath becomes unstable (see example 2). It is preferred that the pH value of the aqueous plating bath ranges from 11 to 13. It is more preferred that the pH value of the aqueous plating bath ranges from 11.0 to 12.5, it is yet more preferred that the pH value ranges from 11.0 to 12.0 or from 11.5 to 12.5 and it is most preferred that the pH value ranges from 11.0 to 11.5.

The pH values can be measured at 25° C. with a pH meter. The measurement has to be continued until the pH values are constant but at least for 1 min. The pH meter has to be calibrated with at least two suitable calibration standards for the pH value range. Also, the electrode to be employed has to be suitable for the pH value range. A suitable pH meter for the measurement of pH values in the aqueous plating bath is SevenMulti S40 professional pH meter combined with an InLab Semi-Micro-L electrode (Mettler-Toledo GmbH, reference system: ARGENTHAL™ with $Ag^+$-trap, reference electrolyte: 3 mol/l KCl). This pH meter can be preferably calibrated with three standards for high pH values at 7.00, 9.00 and 12.00 supplied by Merck KGaA prior to use.

The at least one base in the aqueous plating bath to adjust the pH value of the aqueous plating bath is not particularly limited as long as it is able to form hydroxide ions in aqueous media and thereby increases the pH value of the aqueous plating bath. It is also within the scope of the present invention to use mixtures of two or more bases. Preferentially, the pH value of the aqueous plating bath can be adjusted with commonly used bases such as lithium hydroxide, sodium hydroxide, potassium hydroxide, tetramethylammonium hydroxide, tetraethylammonium hydroxide, ammonia, alkylamines such as methylamine, triethylamine or mixtures thereof.

The aqueous plating bath according to the invention further comprises at least one pH buffer. Such pH buffers can be for example organic acids or weak acidic inorganic compounds or salts of the aforementioned such as for example formic acid, acetic acid, propionic acid, glycine, alkali carbonate, alkali hydrogen carbonate, ammonium compounds such as ammonium hydroxide or tris(hydroxylmethyl-)aminomethane, phosphoric acid, phosphorus acid, salts derived from phosphoric and phosphorus acid and/or boric acid and salts thereof. Furthermore, pH buffer systems based on alkali hydroxide as base with glycine or alkali chlorides as pH buffers are in the scope of the invention. The concentration of the at least one pH buffer in the inventive aqueous plating bath ranges from 1 mmol/l to 200 mmol/l. Preferably, the at least one pH buffer present in the inventive aqueous plating bath is boric acid or a salt of the aforementioned and it is even more preferred to use boric acid or a salt thereof in a concentration of 40 mmol/l to 100 mmol/l.

The aqueous plating bath according to the invention is water based and contains at least 50 wt.-% of water. Additionally, water miscible organic solvents such as alcohols, glycols and glycol ethers may be added. Preferentially, the plating bath comprises only water as solvent.

The aqueous plating bath according to the invention may comprise a second source of reducible metal ions in an amount of 0.01 to 10 mol-%, preferably 0.1 to 7.5 mol-%, more preferably 1 to 5 mol-%, based on the amount of iron ions present in the aqueous plating bath. Such reducible metal ions can be nickel ions or cobalt ions. Nickel ions are preferred. Sources for nickel ions can be any water soluble nickel salts and nickel complexes, preferably selected from the group consisting of nickel sulphate, nickel chloride, nickel carbonate, nickel methanesulphonate, nickel acetate, their respective hydrates and mixtures of the aforementioned. Sources for cobalt ions can be any water soluble cobalt salts and cobalt complexes, preferably selected from the group consisting of cobalt sulphate, cobalt chloride, their respective hydrates and mixtures of the aforementioned.

In another and more preferred embodiment of the present invention, the aqueous plating bath does not contain any intentionally added further reducible metal ions (disregarding any trace impurities commonly present in technical raw materials) and thus allows for binary iron boron alloy coatings to be deposited. Such binary iron boron alloy coatings consist of iron and boron. They typically contain high amounts of boron by what amorphous morphology and corrosion resistance of such coatings can be obtained (examples 4 and 5).

The aqueous plating bath according to the invention may comprise further additives which are known in the art such as wetting agents and/or stabilizers.

The aqueous plating bath according to the invention preferably is not contacted directly or indirectly via the substrate with any sacrificial anodes.

The preparation of the aqueous plating bath according to the invention is not particularly limited. The at least one iron ion source, the at least one boron based reducing agent, the at least one complexing agent, the at least one pH buffer and, optionally, any further additives can be dissolved to the desired concentration in water (or mixtures with solvents thereof) and the pH value can be adjusted with the at least one base in any order. It is advantageous, however, to add the boron based reducing agent after adjusting the pH value with the at least base. A preferential method of preparing the aqueous plating bath according to the invention is described hereinafter. An aqueous solution comprising the at least one iron ion source, the at least one complexing agent, the at least one pH buffer and any further optional additives are dissolved in water and the pH value of the solution is adjusted to 11 or higher with at least one base. A second aqueous solution is adjusted to pH 11 or higher with at least one base prior to the addition of the at least one boron based reducing agent to this second aqueous solution. Then, the two solutions are combined and, if necessary, adjusted in terms of volume, concentration and pH value.

The process according to the invention comprises the steps of (a) providing a substrate, and (b) contacting said substrate with the aqueous plating bath according to the invention and thereby depositing the iron boron alloy coating onto said substrate.

The substrates to be used with in the process according to the invention are selected from the group of metallic substrates, glass substrates, plastics substrates and silicium substrates (also called silicon substrates in the art) such as semiconductor wafer substrates. Substrates comprising one or more surfaces made of metal, glass, plastic and silicium are also understood to be metallic substrates, glass substrates, plastics substrates and silicium substrates in the context of the present invention.

They are not subject to restrictions in form and function. Metallic substrates or metallic surfaces are preferred. Also, non-metallic substrates covered with at least one metallic layer (and thus having a metallic surface) can be used in the inventive process. Copper substrates or copper alloy substrates are used even more preferentially in the process according to the invention. Especially, substrates used in the electronics industry like printed circuit boards or IC substrates are within the scope of the inventive process. It is also possible within the scope of the present invention to deposit the iron boron alloy coating on selected parts of a substrates' surface.

Further steps can optionally be incorporated in the process. These optional steps are (c) an optional pre-treatment step of said substrate, (d) an optional step to remove oxygen from the aqueous plating bath according to the present invention and/or its surrounding atmosphere, (e) an optional step to dry the substrate after the electroless deposition of the iron boron alloy coating.

The above-mentioned steps (a) and (b) are to be carried out in the given order. If the optional step (c) is included in the process according to the invention, then it is carried out between steps (a) and (b).

If the process according to the invention encompasses the optional step (d), it can be carried out at any time of the process, preferably, before and/or while carrying out step (b).

If the optional step (e) is included in the process, then, it concludes the process according to the invention.

The process may further comprise optional rinsing steps with water before, between or after the above-mentioned steps.

It is an embodiment of the present invention to subject the substrate to one or more optional pre-treatment steps (c) which are carried out between steps (a) and (b). The pre-treatment steps are described hereinafter. It is known to those skilled in the art that substrates sometimes are contaminated with residues from processing, human contact or the environment such as for example grease, fat or wax residues. Residues which may be detrimental to the plating are for example oxidation products, grease or wax. Therefore, commonly one or more pre-treatment steps are advantageous in those cases in order to obtain optimal plating results. These pre-treatment steps are known in the art and sometimes referred to as etching or cleaning. These steps include among others removal of said residues with organic solvents, acidic or alkaline aqueous solutions or solutions comprising surfactants, reducing agents and/or oxidation agents. It is also possible within the scope of the present invention to combine the aforementioned steps in order to obtain cleaned substrates. It is also possible to include further rinsing steps before, between or after these pre-treatment steps. Sometimes, an etching step is included in the pre-treatment of the substrate to increase its surface area. This is commonly accomplished by treating the substrate with an aqueous solution comprising strong acids like sulphuric acid and/or oxidation agents like hydrogen peroxide.

Plastic substrates often require to be treated with an oxidative treatment prior to activation. These methods are well-known in the art. Examples for such treatment include etching with acidic or alkaline solutions comprising further oxidations agents such as chromic acid, sulphuric acid, hydrogen peroxide, permanganate, periodate, bismuthate, halogen oxo compounds such chlorite, chlorous acid, chlorate, perchlorate, the respective salts or acids thereof or the respective bromine and iodine derivatives. Examples for such etching solutions are disclosed for example in EP 2 009 142 B1, EP 1 001 052 A2 and U.S. Pat. No. 4,629,636. The latter document also discloses a method of pre-treating a plastic surface including an activation step (Examples I and II therein). Plastic materials in the context of the present invention are selected from a group consisting of acrylonitrile-butadiene-styrene copolymer (ABS copolymer), a polyamide (PA), a polycarbonate (PC), polyimide (PI), epoxy resins, epoxy glass composites and a mixture of an ABS copolymer with at least one further polymer.

Non-metallic substrates, i.e. glass substrates, silicium substrates and plastic substrates in the context of the present invention that are to be plated with the iron boron alloy coating, particularly non-metallic surfaces, may further be pre-treated by means within the skill in the art (as for example described in U.S. Pat. No. 4,617,205, col 8) to make them more receptive or autocatalytic for the deposition. This pre-treatment step is referred to as activation. All or selected portions of a surface may be activated. This activation of glass substrates, silicium substrates and plastic substrates by a noble metal (such as for example copper, silver, gold, palladium, platinum, rhodium, iridium, and preferably palladium in colloidal or ionic form) is carried out between steps (a) and (b). Advantageously, an activation step is not necessary in case of metallic, especially copper, substrates contrary to other methods (see CN 100562603 C).

Within the activation, it is possible to sensitise substrates prior to the deposition of the iron boron alloy coating on them. This may be achieved by the adsorption of a catalysing metal onto the surface of the substrate.

An exemplary and non-limiting pre-treatment process, especially useful for non-metallic substrates, may comprise one or more of the following steps

- optionally, an oxidative treatment for plastic substrates,
- optionally, cleaning and conditioning the substrate to increase adsorption. With a cleaner, organics and other residues are removed. It may also contain additional substances (conditioners) that prepare the surface for the following activation steps, i.e. enhance the adsorption of the catalyst and lead to a more uniformly activated surface,
- etching with persulphate or peroxide based etching systems,
- contacting with a pre-dip solution, such as a hydrochloric acid solution or sulphuric acid solution, optionally with an alkali metal salt, such as sodium chloride, also in the pre-dip solution,
- contacting with an activator solution, that contains colloidal or ionic catalysing metal, such as a noble metal, preferably palladium, causing the surface to become catalytic. The pre-dip serves to protect the activator from drag-in and contaminations,
- and optionally, particularly if the activator contains ionic catalysing metal, contacting with a reducer, wherein the metal ions of an ionic activator are reduced to elemental metal;
- or, if the activator contains colloidal catalysing metal, contacting with an accelerator, wherein components of the colloid, for example a protective colloid, are removed from the catalysing metal.

A non-limiting example of a combination of pre-treatment steps (c) of a metallic substrate is shown in the following scheme

- degrease the metallic substrate with acetone,
- rinse with deionized water,
- etch with an aqueous solution containing sulphuric acid,
- rinse with deionized water, and
- drying of the metallic substrate.

A preferred embodiment of the present invention is to include the optional step (d) to remove oxygen from the aqueous plating bath and/or its surrounding atmosphere which is explained in more detail hereinafter. It is known to those skilled in the art that oxygen present during the plating process of iron based deposits may lead to the formation of iron oxides, iron oxohydroxides and iron hydroxides. It is therefore a preferential embodiment of the inventive process to run the process in an oxygen-free or oxygen-reduced atmosphere. A further step to remove oxygen and, thus, reduce the oxygen concentration in the aqueous plating bath according to the present invention and/or its surrounding atmosphere is therefore a preferred embodiment of the present invention. There is a multitude of different processes available to those skilled in the art how to achieve a removal of oxygen. A plating bath may for example be purged with an inert gas. Alternatively, the removal of oxygen by reduced pressure and then adding an inert gas to the plating bath (and its direct environment) may be useful. It is particularly useful to repeat these steps. Furthermore, the plating process can be performed in an inert atmosphere in an enclosure or in a vessel. Then, the surrounding atmosphere of the aqueous plating bath will also be oxygen-free or will have a reduced oxygen concentration. A plating bath may also be stored in such an atmosphere. As inert gases argon or nitrogen may be preferably used. Purging with an inert gas is preferred according to the present invention as it can be easily achieved and the removal of oxygen results in improved stability of the bath and an increased plating rate (see difference in plating rates in examples 3 and 4).

The substrate is contacted with the aqueous plating bath according to the invention (step (b)). It may be immersed into the plating bath; the plating bath may also be sprayed or wiped thereon. By contacting the substrate with the aqueous plating bath according to the invention, the deposition of the iron boron alloy coating takes place. It is preferred that the substrate is not electrically connected to any sacrificial anode. It is also preferred that the aqueous plating bath according to the invention is not contacted to any sacrificial anode (e.g. by immersion the latter into the bath). It is thus preferred that neither the substrate nor the aqueous plating bath according to the invention are contacted with a sacrificial anode.

The contact of the substrate and the aqueous plating bath according to the invention in step (b) in the process according to the present invention can be performed in horizontal, reel-to-reel, vertical and vertically conveyorized plating equipment. A particularly suitable plating tool which can be used to carry out the process according to the present invention is disclosed in US 2012/0213914 A1.

After contacting the substrate with the aqueous plating bath according to the invention residual amounts of water and/or other solvents can be removed in an optional drying step (e). This can be done by removing these liquids mechanically (e.g. wiping), by applying gas streams (air or inert gases) and/or by elevated temperatures. If there is sufficient time, the substrates can be stored under ambient conditions until dry. Alternatively, the substrates can be further processed directly after the deposition.

The temperature of the aqueous plating bath during the plating process ranges from 20° C. to 90° C., and preferably, it ranges from 30° C. to 70° C. The most preferential temperature of the aqueous plating bath in the plating process ranges from 40° C. to 50° C.

It is preferential to agitate the inventive aqueous plating bath during the plating process of the iron boron alloy coating. Agitation may be accomplished for example by mechanical movement of the aqueous plating bath like shaking, stirring or continuously pumping of the liquids or intrinsically by ultrasonic treatment or by elevated temperatures or by gas feeds (such as purging the aqueous plating bath with an inert gas).

The process according to the invention is not particularly restricted in terms of its duration. The process according to the invention can be carried out as long as it is required to achieve a desired objective like for example a certain iron boron alloy coating thickness. A preferred duration, however, ranges from 1 min to 600 min and more preferred from 5 min to 120 min.

The process according to the invention allows for iron boron alloy coatings to be deposited. If a second reducible metal ion is present in the aqueous plating bath according to the invention an iron boron alloy coating doped with the second reducible metal will be deposited.

The process according to the invention particularly (and preferably) allows for binary iron boron alloy coatings to be formed which consist of 10 to 90 at.-% iron with the balance (to 100 at.-%) being boron, preferably 40 to 80 at.-% iron with the balance (to 100 at.-%) being boron (see example 4). The process according to the invention therefore allows for binary iron boron alloys to be deposited without the requirement of a sacrificial anode.

It is an advantage of the process according to the invention that no sacrificial anode is necessary in order to obtain iron boron alloy coatings on substrates. This is the prerequisite in the production of PCBs and IC substrates as the miniaturisation demands smaller and smaller scales and more complex patterns and it is not possible to contact these patterns with an external electrical source in an efficient manner. The abstinence of any sacrificial anode requirement is also a necessary precondition for non-conductive substrates to be used in the inventive process because electrons from any sacrificial anode cannot pass through such non-conductive substrates to allow for iron ion reduction at their surface to occur.

It is a further advantage of the process according to the invention that the deposition of the iron boron alloy coating proceeds with high plating rates (see examples 3, 4 and 6).

It is another advantage of the present invention that the iron boron alloy coatIngs provided by the process according to the invention are glossy and homogeneous in thickness distribution and coverage of the substrate (see example 3).

The formed iron boron alloy coatings on the metallic substrates show amorphous character due to their high boron content which is desirable for corrosion resistant coatings (see example 4). They, therefore, exhibit good corrosion resistance (see example 5).

The terms plating and deposition are used interchangeably herein.

The following non-limiting examples are to illustrate the present invention.

EXAMPLES

The characterisation of the iron boron alloy coatings was performed using Nova NanoLab 200 and Helios NanoLab 650 scanning electron microscopes (SEM, both FEI Company). X-ray photo electron spectroscopy (VersaProbe XPS, Physical Electronics GmbH) was used to measure the composition of the iron boron alloy coatings. A Scintag x-ray diffractometer (XRD) was used to characterise the crystallinity of the iron boron alloy coatings. The thickness of the iron boron alloy coatings was determined from a frequency change in a quartz crystal with a quartz crystal microbalance (SRS QCM200, Stanford Research Systems, Inc.).

Open circuit potential measurements (OCP) were conducted using a VersaStat Model 4 potentiostat (Princeton Applied Research) using a Saturated Calomel Electrode (SCE, Radiometer Analytical) as a reference.

Corrosion resistance was also measured using the VersaStat Model 4 potentiostat with the SCE reference electrode and platinum wire counter electrode (Encompass) in a 3.5 wt.-% salt solution of sodium chloride. Polarization sweeps were at a scan rate of 2 mV/s over a 600 mV window centred on the OCP of the substrate in the salt solution.

pH values were measured with a pH meter (SevenMulti S40 professional pH meter, electrode: InLab Semi-Micro-L, Mettler-Toledo GmbH, ARGENTHAL™ with $Ag^+$-trap, reference electrolyte: 3 mol/l KCl) at 25° C. The measurement was continued until the pH value became constant, but in any case at least for 3 min. The pH meter was calibrated with three standards for high pH values at 7.00, 9.00 and 12.00 supplied by Merck KGaA prior to use.

The solvents were stripped off oxygen by purging them with argon for 1 h prior to use if not mentioned otherwise.

Pre-Treatment of the Substrates

Copper foils were used as metallic substrates in the plating experiments. The individual foil samples were degreased with acetone, and then washed with deionized water. Thereafter, they were etched with 2 mol/l solution of sulphuric acid in water for 15 seconds. After a concluding rinsing with deionized water, they were ready for use.

Example 1: Method According to US 2009/0117285 (Comparative)

An aqueous plating bath having a pH value of 10.2 (adjusted with sodium hydroxide) and containing 50 mmol/l ammonium ferrous sulphate, 250 mmol/l sodium borohydride, 150 mmol/l sodium citrate and 49 mmol/l boric acid was used to plate a copper foil. The pre-treated copper substrate was therefore immersed into the aqueous plating bath at 24° C. for 15 min and 45 min, respectively, in a plating cell made of glass. The appearance of the plating bath and the thickness of the formed iron boron alloy coating were monitored over time (see table 1).

TABLE 1

Example 1 (comparative).

| Plating time [min] | Coating Thickness [nm] | Appearance of the plating bath |
|---|---|---|
| 15 | 2.3 | Formation of a black precipitate, otherwise clear solution |
| 45 | 7.4 | Precipitation on the cell sides, the solutions became turbid |

The plating bath of example 1 lacked stability and quickly formed a black precipitate in the bath itself and on the surfaces of the plating vessel. The iron boron alloy coating obtained by this method was dull and the surface of the substrate was inhomogeneously coated. The deposition rate of the iron boron alloy coating was very slow.

Example 2: pH Value of 10.5 (Comparative)

An aqueous plating bath having a pH value of 10.5 (adjusted with sodium hydroxide) and containing 50 mmol/l ammonium ferrous sulphate, 300 mmol/l sodium borohydride, 49 mmol/l boric acid and 127 mmol/l Rochelle's salt was used to plate a copper foil. The pre-treated copper substrate was therefore immersed into the plating bath at 41° C. The appearance of the plating bath and the thickness of the formed iron boron alloy coating were monitored over time.

The plating bath quickly deteriorated and was too unstable to be used in a plating process.

Example 3: Iron Boron Alloy Coatings on a Copper Substrate (Inventive)

An aqueous plating bath having a pH value of 11 (adjusted with sodium hydroxide) and containing 50 mmol/l ammonium ferrous sulphate, 300 mmol/l sodium borohydride, 127 mmol/l Rochelle's salt and 49 mmol/l boric acid was used to plate a copper foil. The aqueous plating bath was not purged with argon and therefore, the plating experiment was run under air. The pre-treated copper substrate was immersed into the plating bath at 41° C. for 15 min and 45 min, respectively, in a plating cell made of glass. The appearance of the plating bath and the thickness of the formed iron boron alloy coating were monitored over time (see table 2).

TABLE 2

| Example 3 (inventive). | | |
|---|---|---|
| Plating time [min] | Deposit thickness [nm] | Appearance of the plating bath |
| 15 | 58.2 | Pale green, clear solution, gas evolution |
| 45 | 116.1 | Colour shift to black, decreasing gas evolution |

The aqueous plating bath according to example 3 showed a good stability and a high plating rate. A glossy iron boron alloy coating was formed homogeneously on the copper substrate surface. The substrate treated therewith was homogeneously covered with a shiny and glossy silvery iron boron alloy coating formed on the entire surface of the substrate.

Example 4: Iron Boron Alloy Coatings on a Metallized Substrate (Inventive)

An aqueous solution containing 50 mmol/l ammonium ferrous sulphate, 40 mmol/l boric acid and 127 mmol/l Rochelle's salt was prepared with deionized water. The pH value of the solution was adjusted to pH 11 with sodium hydroxide in a beaker. In a second beaker, a second aqueous solution was prepared by first adjusting the pH value to 11 with sodium hydroxide and then dissolving 300 mmol/l sodium borohydride in this second solution. The two solutions were combined and the final volume of the mixture was replenished with deionized water to 100 mL and the pH value was adjusted to 11 with sodium hydroxide. The mixture was then heated to 45° C. and purged with argon while the plating took place. A Si wafer with a layer array of silica, a barrier layer made of TaN and a copper layer (the latter layers deposited by PVD) was immersed after pretreatment into said aqueous plating bath for 30 min.

Figure 2:
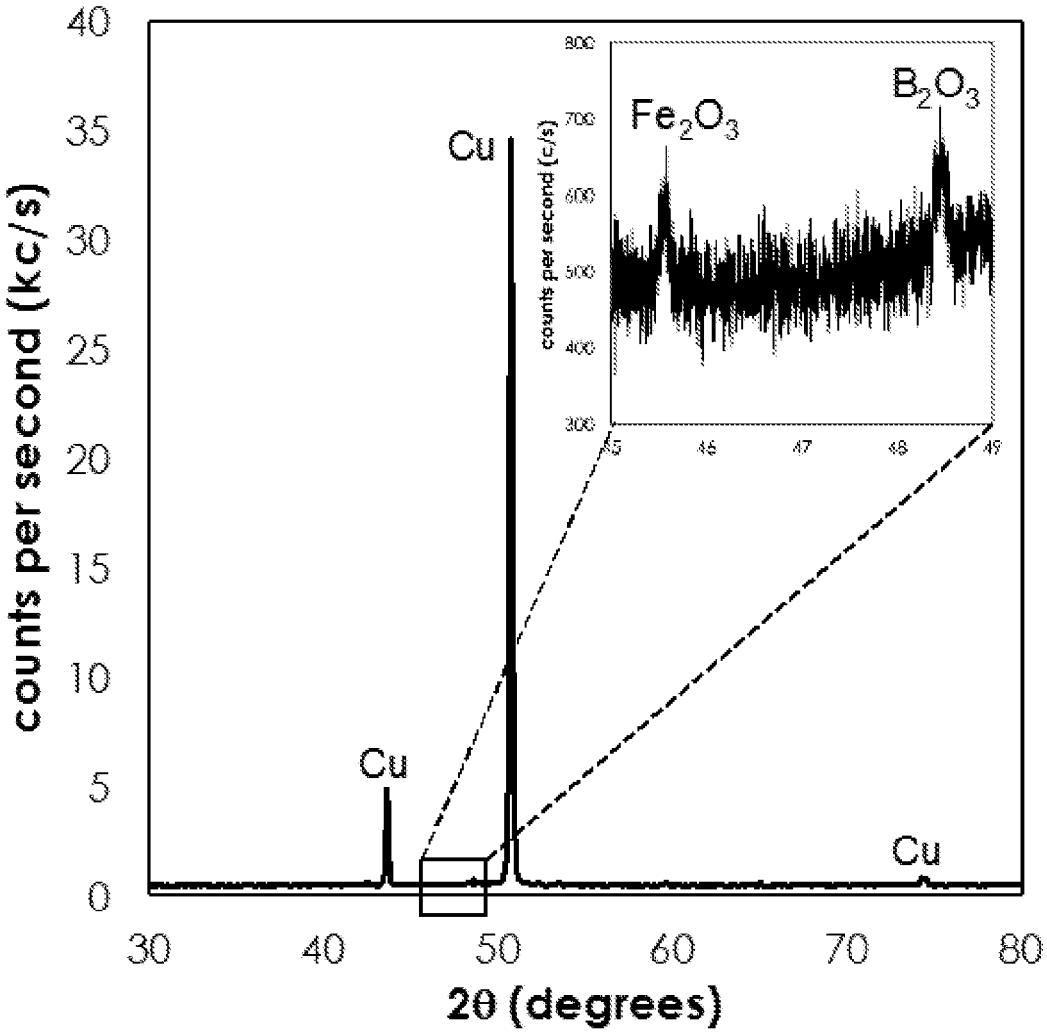
FIG. 2:
An x-ray diffraction measurement (XRD) of an iron boron alloy coating formed by the process according to the invention (see example 4).

The aqueous plating bath according to example 4 showed good stability and an average iron boron alloy coating plating rate of 0.24 μm/h on the wafer substrate. The iron boron alloy coating was analysed with XPS to consist of 30.8 atomic-% boron and 69.2 atomic-% iron (see FIG. 1). The crystallinity of the iron boron alloy coating was confirmed by XRD to be amorphous (see FIG. 2). A minor surficial oxidation of the iron boron alloy coating was found (28=45.6 and 48.4 for iron and boron oxides, respectively).

Example 5: Corrosion Resistance of Iron Boron Alloy Coatings (Inventive)

An aqueous plating bath as described in example 3 was prepared and purged with argon. A pre-treated copper substrate was immersed in said plating bath for 1 h under continuous argon purging. The thus coated substrate had a homogeneously covered surface finished with an iron boron alloy coating. This coated substrate was subjected to a corrosion test in 3.5 wt.-% solution of sodium chloride. Polarisation measurements were conducted at a scan rate of 2 mV/s over a 600 mV window (from OCP −300 mV to OCP +300 mV). The polarization curves indicated a corrosion potential of −0.81 V for the formed iron boron alloy. The corrosion current density was found to be 31.1 $\mu A/cm^2$ for the iron boron alloy coating.

This corrosion resistance of the iron boron alloy coating formed on the copper substrate was in an acceptable range for the application in the PCB industry.

Example 6: Variation of Molar Ratios of Boron Based Reducing Agent to Iron Ion Source Three aqueous plating baths each having a pH value of 11 (adjusted with sodium hydroxide) and containing 50 mmol/l ammonium ferrous sulphate, 127 mmol/l Rochelle's salt, 49 mmol/l boric acid and sodium borohydride in amounts as given in table 3, were used to plate quartz crystals covered with gold whereon a layer of copper had been deposited (thus providing a copper surface). The DI water was purged with argon for 50 minutes before make-up and use of the aqueous plating baths. The pre-treated copper substrates were immersed into the plating baths at 41° C. for 70 min in plating cells made of glass. The appearance of the plating baths and the thicknesses of the formed iron boron alloy coatings were monitored over time (see table 3).

TABLE 3

| Example 6. | | | | | |
|---|---|---|---|---|---|
| # | Bath | Concentration of $NaBH_4$ [mM] | Molar ratio of reducing agent/Fe | Plating time [min] | Deposit thickness [nm] |
| 1a | 1 (comparative) | 250 | 5/1 | 10 | 36.9 |
| 1b | 1 (comparative) | 250 | 5/1 | 20 | 56.9 |
| 1c | 1 (comparative) | 250 | 5/1 | 30 | 62.2 |
| 1d | 1 (comparative) | 250 | 5/1 | 40 | 68.0 |
| 2a | 2 (inventive) | 500 | 10/1 | 10 | 55.0 |
| 2b | 2 (inventive) | 500 | 10/1 | 20 | 107.0 |
| 2c | 2 (inventive) | 500 | 10/1 | 30 | 187.4 |
| 2d | 2 (inventive) | 500 | 10/1 | 40 | 251.3 |
| 3a | 3 (inventive) | 550 | 11/1 | 10 | 9.0 |
| 3b | 3 (inventive) | 550 | 11/1 | 20 | 18.6 |
| 3c | 3 (inventive) | 550 | 11/1 | 30 | 29.3 |
| 3d | 3 (inventive) | 550 | 11/1 | 40 | 32.4 |

The appearance of the different plating baths did not change significantly over the course of the experiments. Prior to the immersion of the substrates, the plating baths were heated for five minutes over which time they all changed from a medium-light green to their final colours, but these colours did not change any further.

Bath 1 (relates to entries 1a to 1d in table 3, comparative) had a pale green hue and many tiny black particles were formed. A strong gas evolution was visible.

Bath 2 (relates to entries 2a to 2d in table 3, inventive and representing a preferred molar ratio of boron based reducing agent to iron ion source) showed a typical appearance for a plating bath and was very black and non-transparent. Some gas bubbles were visible, but not as many as in bath 1.

Bath 3 (relates to entries 3a to 3d in table 3, inventive) looked almost exactly like bath 2, but showed a significantly stronger gas evolution.

The repetition with a variation of comparative bath 1 containing even less boron based reducing agent (50 mmol/l and 150 mmol/l) did not result in any iron boron alloy coating on the substrate after 15 min.

It can be clearly seen that the deposition of an iron boron alloy coating proceeded quickly and steadily if the ratio of boron based reducing agent to ferrous salt in the aqueous plating bath was 10 molar equivalents to 1 molar equivalent (column denominated "Molar ratio of reducing agent/Fe" in table 3). The plating bath also showed a good stability.

If the ratio was 5 equivalents of boron based reducing agent to ferrous salt as in bath 1 (entries 1a to 1d in table 3) the plating rate started with a lower initial value and the plating did not proceed continuously and ceased to plate almost entirely after about 20 min. Also, the formation of black particles (probably iron or iron salt precipitates) indicates a low life-time of the plating bath. Such a bath is hence not suitable for iron boron alloy coating formation.

If the ratio was above 10 equivalents of boron based reducing agent to ferrous salt as in bath 3 (entries 3a to 3d in table 3) the plating rate started with a very low initial value and did not increase any further. However, the plating bath showed a good stability.

The invention claimed is:

1. An aqueous plating bath for the electroless deposition of iron boron alloy coatings, comprising (i) at least one iron ion source;

(ii) at least one boron based reducing agent;

(iii) at least one complexing agent;

(iv) at least one pH buffer; and (v) at least one base, wherein the pH value of the aqueous plating bath is 11 or higher and the molar ratio of the boron based reducing agents in relation to the iron ions in the aqueous plating bath is at least 6:1 and wherein it does not contain any intentionally added further reducible metal ions or it comprises a second source of reducible metal ions in an amount of 0.01 to 10 mol-% based on the amount of iron ions present in the aqueous plating bath.

2. The aqueous plating bath according to claim 1, wherein the at least one iron ion source is a water soluble ferrous salt.

3. The aqueous plating bath according to claim 1, wherein the concentration of the iron ions therein ranges from 25 mmol/l to 120 mmol/l.

4. The aqueous plating bath according to claim 1, wherein the molar ratio of the boron based reducing agents to the iron ions lies in the range of 6:1 to 10:1.

5. The aqueous plating bath according to claim 1, wherein the pH value ranges from 11 to 13.

6. The aqueous plating bath according to claim 1, wherein the source of reducible metal ions is selected from nickel ions and cobalt ions.

7. A process for the electroless deposition of iron boron alloy coatings on substrates, wherein the process comprises the steps (a) providing a substrate, and (b) contacting said substrate with an aqueous plating bath according to claim 1; and thereby depositing an iron boron alloy coating onto said substrate.

8. The process for the electroless deposition of iron boron alloy coatings on substrates according to claim 7, wherein the substrate is not electrically connected to any sacrificial anode.

9. The process for the electroless deposition of iron boron alloy coatings on substrates according to claim 7, wherein the process further comprises a step to remove oxygen from the aqueous plating bath, its surrounding atmosphere, or from both the aqueous plating bath and its surrounding atmosphere.

10. The process for the electroless deposition of iron boron alloy coatings on substrates according to claim 9, wherein the aqueous plating bath, its surrounding atmosphere, or from both the aqueous plating bath and its surrounding atmosphere is purged with an inert gas to remove oxygen therefrom.

11. The process for the electroless deposition of iron boron alloy coatings on substrates according to claim 7, wherein the substrate is selected form the group consisting of metallic substrates, glass substrates, silicium substrates and plastic substrates.

12. The process for the electroless deposition of iron boron alloy coatings on substrates according to claim 11, wherein copper substrates or copper alloy substrates are used.

13. The process for the electroless deposition of iron boron alloy coatings on substrates according to claim 11, wherein the glass substrates, silicium substrates or plastic substrates are activated by a noble metal between steps (a) and (b).

14. The process for the electroless deposition of iron boron alloy coatings on substrates according to claim 7, wherein for binary iron boron alloys are deposited.

15. The process for the electroless deposition of iron boron alloy coatings on substrates according to claim 14, wherein the binary iron boron alloy coatings consist of 10 to 90 at.-% iron with the balance (to 100 at.-%) being boron.

* * * * *